US007043883B1

(12) United States Patent
Cederberg et al.

(10) Patent No.: US 7,043,883 B1
(45) Date of Patent: May 16, 2006

(54) DOOR JAMB

(76) Inventors: Carl A. Cederberg, 2255 Willow Dr., Long Lake, MN (US) 55356; Cory R. Cederberg, 2255 Willow Dr., Long Lake, MN (US) 55356; Cully T. Cederberg, 2255 Willow Dr., Long Lake, MN (US) 55356

( * ) Notice: Subject to any disclaimer, the term of this patent is extended or adjusted under 35 U.S.C. 154(b) by 0 days.

(21) Appl. No.: 09/382,709

(22) Filed: Aug. 23, 1999

Related U.S. Application Data

(63) Continuation-in-part of application No. 08/936,176, filed on Sep. 24, 1997, now abandoned.

(51) Int. Cl.
*E06B 1/04* (2006.01)

(52) U.S. Cl. ..... 52/204.1; 52/217; 52/734.1; 52/204.1; 52/211; 52/213

(58) Field of Classification Search ..... 52/204.1, 52/212, 217, 734.1, 211, 213
See application file for complete search history.

(56) References Cited

U.S. PATENT DOCUMENTS

| | | | | | |
|---|---|---|---|---|---|
| 1,180,726 | A | | 4/1916 | Keil | 52/212 |
| 1,855,470 | A | | 4/1932 | Bilton | 52/217 X |
| 1,995,764 | A | | 3/1935 | Bohnsack | 52/217 X |
| 2,454,523 | A | | 11/1948 | Philip | 52/212 |
| 2,860,744 | A | | 11/1958 | Mascari | 52/212 |
| 3,340,663 | A | | 9/1967 | Collard | 52/212 X |
| 3,420,003 | A | | 1/1969 | Cline | 52/212 X |
| 3,788,019 | A | * | 1/1974 | Kiselewski | 52/212 |
| 3,981,103 | A | | 9/1976 | McAllister | 52/217 X |
| 4,589,229 | A | | 5/1986 | Warren | 52/217 X |
| 4,787,184 | A | | 11/1988 | Boidron | 52/217 |
| 4,986,034 | A | | 1/1991 | Mozuras et al. | 52/217 X |
| 5,048,997 | A | * | 9/1991 | Peterson | 403/295 |
| 5,233,802 | A | | 8/1993 | Rogers | 52/212 |
| 5,365,708 | A | * | 11/1994 | Winston | 52/212 |
| 5,412,909 | A | | 5/1995 | Wu | 52/212 X |
| 5,435,106 | A | | 7/1995 | Garries et al. | 52/734.1 X |
| 5,485,708 | A | | 1/1996 | Johnson | 52/212 X |
| 5,491,940 | A | | 2/1996 | Bruchu | 52/217 X |
| 5,528,869 | A | | 6/1996 | Boomer et al. | 52/217 X |
| 5,634,303 | A | | 6/1997 | Ellingson | 52/212 X |
| 5,758,458 | A | * | 6/1998 | Ridge | 52/204.1 |
| 5,787,660 | A | * | 8/1998 | Adams | 52/212 |
| 5,941,033 | A | * | 8/1999 | Adams | 52/212 |

FOREIGN PATENT DOCUMENTS

| | | | | |
|---|---|---|---|---|
| AU | 200786 | * | 11/1954 | |
| CH | 571145 | * | 6/1974 | |
| DE | 1912361 | | 9/1970 | 52/212 |
| DE | 2260745 | | 6/1974 | 52/212 |
| SE | 106130 | | 12/1942 | 52/212 |

* cited by examiner

*Primary Examiner*—Carl D. Friedman
*Assistant Examiner*—Chi Q. Nguyen
(74) *Attorney, Agent, or Firm*—Norman P. Friederichs

(57) ABSTRACT

Disclosed is a door jamb having a pair of tubular side jambs and a tubular head jamb, the side jambs and the head jamb each have an outer low maintenance element, an inner structural element, and an intermediate element for receiving a portion of each of the outer and inner elements to secure such outer and inner elements together in selected positions to provide a desired depth of the door jamb.

16 Claims, 7 Drawing Sheets

119
117
181
122
160a
153
120
152
124
127
192c
192a
192b
127a
123
121
192
171

DOOR JAMB

This is a continuation-in-part of application Ser. No. 08/936,176 filed Sep. 24, 1997, now abandoned. Priority of the prior application is claimed pursuant to 35 USC § 120.

FIELD OF THE INVENTION

The present invention relates to door structures for residential homes and more particularly to door jambs for homes.

BACKGROUND OF THE INVENTION

Thresholds and entry ways have been a significate part of residential homes since the day of the cave man. History indicates that a stone was rolled in front of an entry way in early years to protect the inhabitants from the outside. At one time, animal skins served as an easily operable closure for the residence. Still later, solid doors mounted on hinges were invented. Door structures have remained rather consistent in structure for the past several hundred years.

Over the years the structure of the residence has changed. Early man lived in a cave. Constructed residences also have changed over the years. Early homes were made of weather resistant material, e.g., stones, one piled upon another. Later homes were made of wood that required surface protection such as painting. In recent years low maintenance, e.g., weather resistant material has been used in home sidings. These sidings have generally been vinyl siding. With this recent change to vinyl siding, the door jambs have remained of prefabricated wood structure.

Generally the door structure has included a panel mounted on two or more hinges. The door panel and the supporting hinges are mounted within a casement surrounding the opening in the residence. The door panel has been constructed of a variety of materials such as fancy carved wood, light weight hollow core wood paneling, as well as, impenetrable steel.

The structure surrounding the opening is typically referred to as a door jamb. The door jamb has a threshold which is the structure extending across the bottom side of the opening, and a pair of upright side jambs and a head jamb which are mounted in a rough opening. The rough opening typically is defined by a floor structure at the bottom, a pair of up right dimension lumber supports, i.e., 2×4s at each side of the rough opening and a header across the upper portion of the rough opening. The rough opening will usually include a wall board adjacent to the opening on the inner surface and outside sheeting and perhaps finish siding on the outer side of the rough opening.

A problem has existed in that door jambs have been of wood construction and thus not weather resistant. Attempts have been made to improve the weather resistance of the door jamb by coating the exposed wood door jambs with paint and/or a vinyl or aluminum coating. This has only been partially successful. The paint tends to deteriorate in the weather and the vinyl or aluminum coating tends to separate from the wood leaving the wood exposed to the weather deterioration.

Another problem has commonly been encountered in building residential homes due to variations in the thickness of the wall defining the rough opening. The thickness of the wall depends on the materials used in the construction. For example, the inner wall may be ½ inch dry wall, ⅝ inch dry wall or ⅝ inch dry wall plus ¼ inch wood paneling. The structural lumber used in the wall may be what is commonly referred to as construction lumber e.g. 2/4s or 2/6s. The outer wall structure may be ⅝ inch sheeting, 1 inch wood sheeting, ⅝ inch plywood sheeting, ½ inch plywood sheeting or sheeting of other thicknesses. In addition, the outer siding or finish material may be of various thicknesses. For example: A quarter inch asphalt siding may be used, alternatively, half inch wood board siding may be present. The most popular siding today is vinyl siding. The vinyl siding requires minimal care and upkeep. Vinyl siding is made of any of various polymeric materials. In some instances, insulation is provided within the vinyl siding and in other instances, sheets of insulation are provided between the sheeting and the outer siding.

Thus the thickness of the wall structure will vary depending on the materials selected. This has generally required that the door jamb be modified on site after the wall structure has been put in place. While it may have in the past been desirable to have pre-constructed door jambs, often the pre-constructed door jamb has not been of the appropriate dimensions to fit the desired wall structure. This required that door jamb extenders in the form of strips of wood material be used to provide the desired dimension. Alternatively, the door jambs were cut to a narrower dimension, such as on a table saw.

SUMMARY OF THE INVENTION

The present invention relates to a pre-constructed door jamb that accommodates/fits walls of various thicknesses. For example: the door jamb may accommodate wall thicknesses between 4⁹⁄₁₆ and 7⅛ inches in width. The door jamb is constructed of thin walled extruded vinyl tubular members. The members include a pair of side jambs, e.g. leg jambs, and a head jamb. The side jambs each have an upper end and a lower end. The head jamb has a pair of outer ends for mating with the respective upper end of the side jambs. The lower ends of the side jambs mates with a threshold.

In a preferred embodiment of the present invention, each such jamb member is constructed of three elements, an outer low maintenance element, an intermediate low maintenance element and an inner wooden element. In other words, each jamb member includes a first element that may be disposed towards the outside of the residence; e.g. the outer or low maintenance element, and an inner element or wood element disposed toward the inside of the residence, e.g. structural element. The intermediate low maintenance element serves to interconnect the outer and inner elements.

The outer element may have an outer low maintenance portion that is exposed to the weather and a portion that defines an inwardly extending rectangular structure that frames the outer portion of the doorway. The outer element may be a shaped tubular polymer extrusion. The intermediate element is some what S-shaped including oppositely facing cavities. The inner element may be either a rectangular wooden structure or in some instances a rectangular tubular polymer structure. The rectangular portion of the outer element may fit snugly in the first of the pair of cavities of the intermediate element. The inner element, e.g. rectangular wooden structure may fit snugly in the second of the cavities in the intermediate element. Thus the intermediate element interconnects the outer element and the inner element of the door jamb.

IN THE DRAWINGS

DETAILED DESCRIPTION OF THE PRESENT INVENTION

Figure 1:
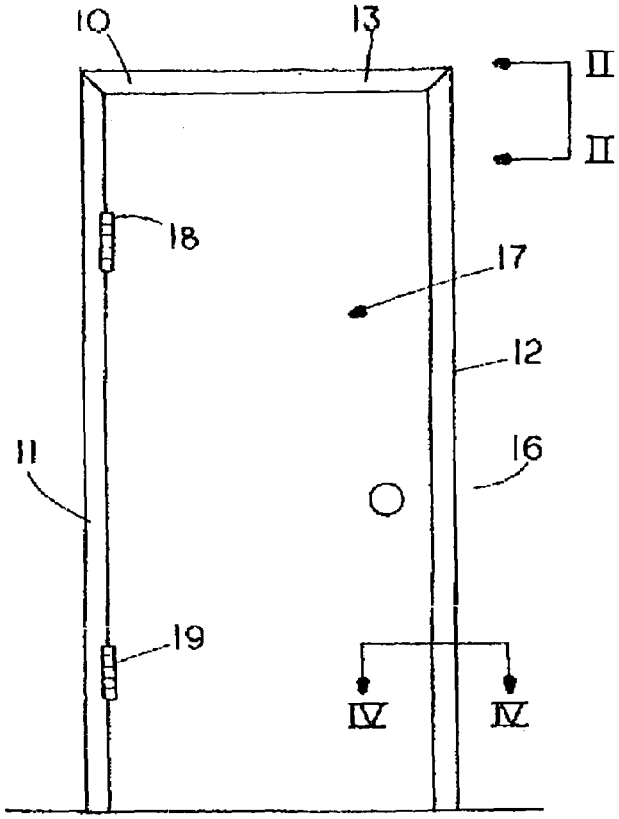
FIG. 1 shows a perspective view of an entryway having the door jamb of the present invention in place as viewed from inside the residence.
Figure 2:
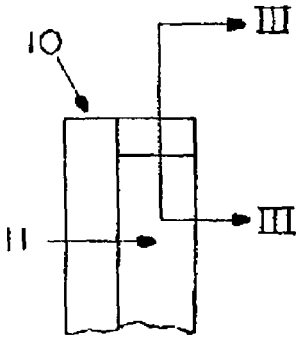
FIG. 2 shows a view of a present invention taken along the lines of II—II in FIG. 1.
Figure 3:
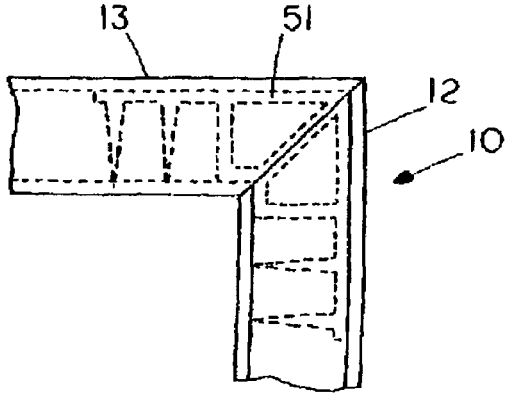
FIG. 3 shows a sectional view of a portion of the present invention showing how the polymer side jambs and polymer head jamb may be joined using a corner key thereby forming right angles.
Figure 5:
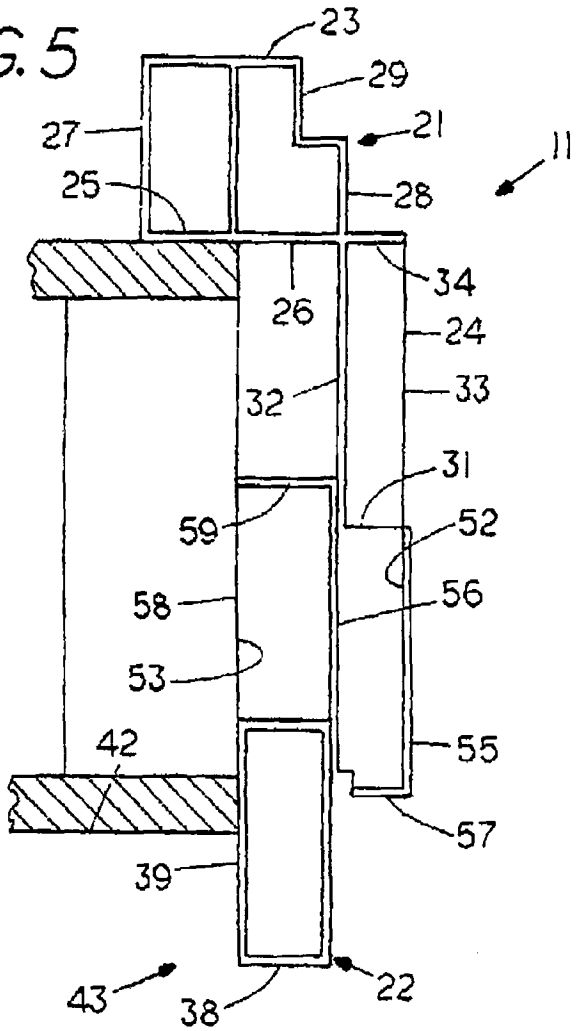
FIG. 5 shows a sectional view of the embodiment of FIG. 4 in an assembled position.
Figure 4:
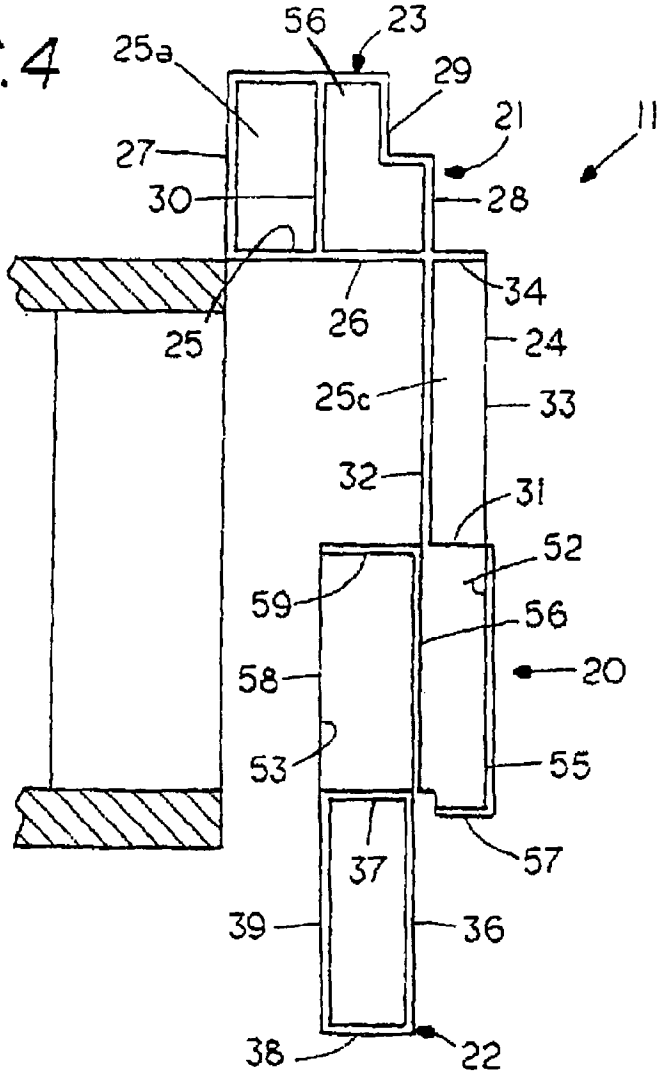
FIG. 4 shows an exploded sectional view of one embodiment of the present invention taken along the line IV—IV in FIG. 1.
Figure 6:
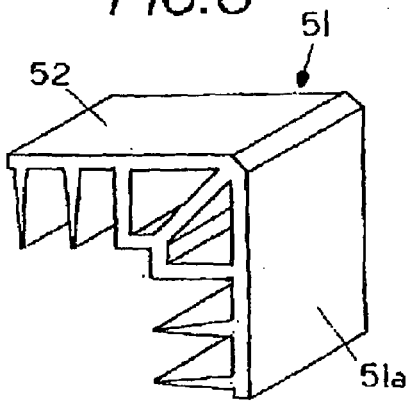
FIG. 6 shows a key for engaging a side jamb and a head jamb.

Door Jamb 10 of the present invention is illustrated in FIGS. 1–5 and includes a pair of upright or side jambs 11 and 12 and a head jamb 13. The door jamb 10 of the present invention may be mounted within the rough opening 16, of a building such as a home or personal residence. The door jamb 10 may be provided with a door 17 mounted on a plurality of hinges 18 and 19. The rough opening 16 and the door 17 may be of conventional construction. The door jamb 10 including the side jambs 11 and 12 and the head jamb 13 may be constructed of material having identical cross sectional shape. Therefore only the cross sectional shape of side jamb 11 will be described in detail.

The door jamb 10 (FIG. 4) has a three element construction, namely, an outer element 21, an intermediate element 20 and an inner element 22. Element 21 has an exposed or exterior portion 23 and an elongated portion 24. The exterior portion 23 may include a rear wall 26, a pair of side walls 27, 28 and a outer wall 29. The portion 23 may include an inside wall 30 for strengthening purposes. The wall 29 may be of any desired shape such as stepped or arcuate.

The elongated portion 24 may include an inner wall 31, a pair of side walls 32, 33 and an outer wall 34. The outer element 21 may be extruded in the form of a closed, continuous shaped tube 25. In other words the walls 26, 27, 28, 29, 30, 31, 32, 33 and 34 may be integral with the next adjacent wall thereby forming a tube. The tube 25 may have a plurality of chambers 25*a*, 25*b* and 25*c*.

The intermediate element 20 may be formed by extrusion and includes a pair of oppositely facing cavities 52 and 53 defined by a plurality of walls. Element 20 is constructed of side walls 55 and 56 and an end wall 57 which define cavity 52. Element 20 further includes side wall 58 and end wall 59 which together with side wall 56 define the cavity 53.

The structural element 22 may be constructed of any desired material such as wood, typically pine, oak or fir. Alternatively structural element 22 may be a closed extruded tube defined by walls 36, 37, 38, 39. The structural element 22 may have a decorative strip or molding attached thereto. The decorative strip may be molding that is present in conventional door jambs.

A PREFERRED EMBODIMENT

Figure 7:
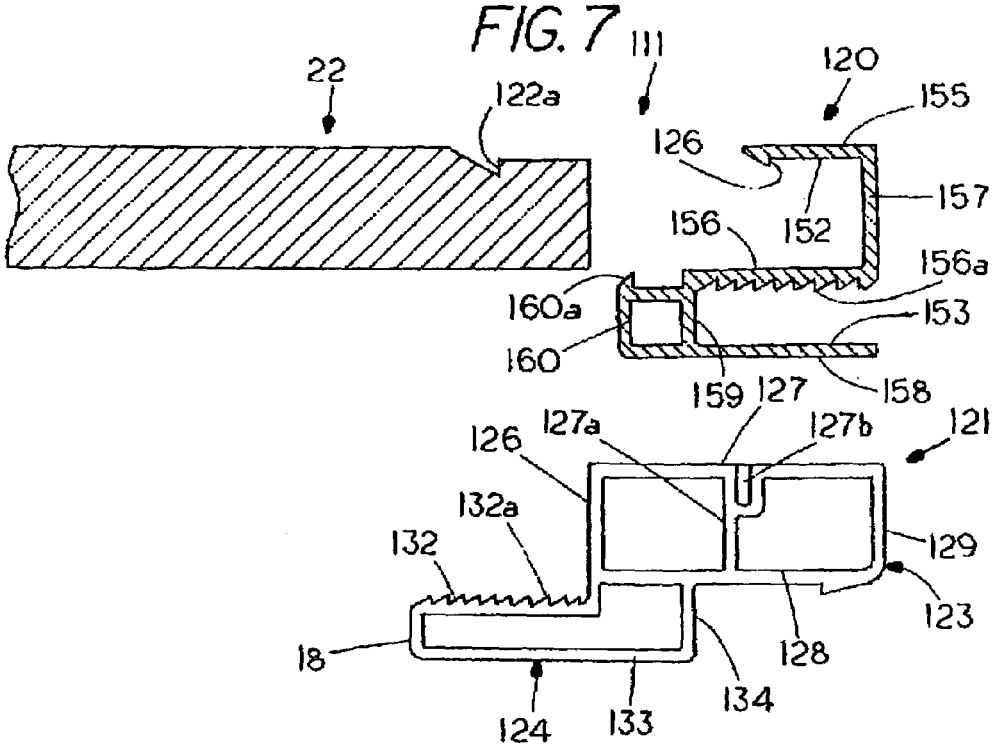
FIG. 7 shows an exploded sectional view of a preferred embodiment of the present invention.
Figure 8:
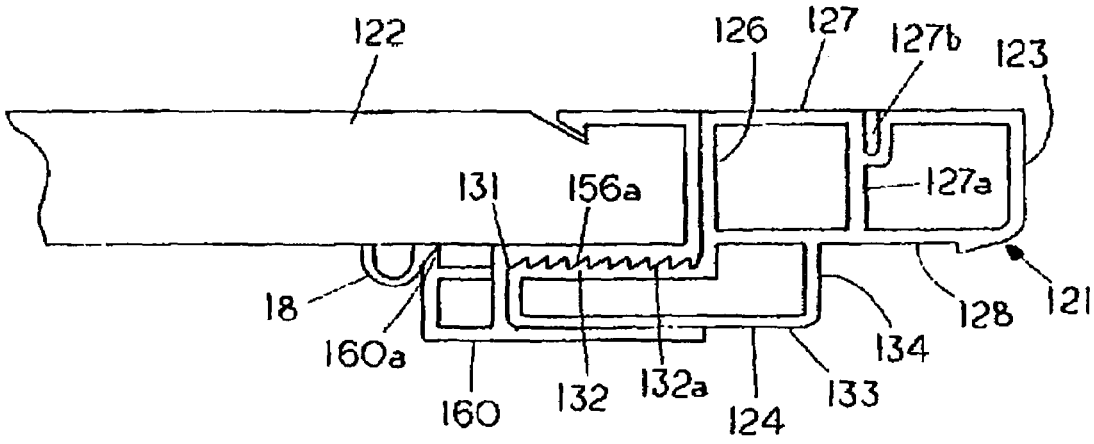
FIG. 8 shows a sectional view of the embodiment of FIG. 7 in an assembled position.

A preferred embodiment of the present invention is shown in FIGS. 7 and 8. The side jamb 111 (FIGS. 7 and 8) includes an outer low maintenance element 121, an intermediate low maintenance connecting element 120 and an inner structural element 122.

The outer element 121 may be constructed by extrusion of a polymeric material, such as vinyl in a shape as shown in the cross sectional view of FIGS. 7 and 8. The outer low maintenance element 121 consists of an exposed outer low maintenance portion 123 and an elongated portion 124. The outer low maintenance portion 123 may include a rear wall 126, a pair of side walls 127, 128 and an outer wall 129. The wall 129 may be shaped as desired. In some instances the shape will be decorative such as being S-shaped. one or more strengthening walls 127*a* may be provided which extend between walls 127 and 128. The wall 127 may have a drip cap or flashing slot 127*a* defined therein for purposes hereinafter described.

The elongated portion 124 may include an inner wall 131, a pair of side walls 132, 133 and an outer wall 134. The wall 132 has a plurality of tooth shaped longitudinal ribs 132*a* for purposes hereinafter described. The outer element 121 may be extruded in the form of a closed, continuous shaped tube. The walls 126 through 134 each may be integral with the next adjacent wall. In other words, wall 126 is integral along one edge with the adjacent edge of wall 127 which in turn is integral along one edge with the adjacent edge of wall 129 and so on.

The structural element 122 may be formed from a wood board such as pine, oak or fir. The element 122 desirably is a nominal one inch board having a notch 122*a* for purposes hereinafter described.

The intermediate element 120 may be formed by extrusion and includes a pair of oppositely facing cavities 152 and 153 defined by a plurality of walls, 155, 156, 158 and 159. In other words, element 120 is constructed of side walls 155, 156 and an outer or end wall 157 which define cavity 152. Element 120 further includes side wall 158 and end wall 159 which together with side wall 156 define the cavity 153. The wall 155 includes a projection 155*a* for purposes described hereinafter. The wall 156 includes a plurality of tooth shaped longitudinal projections or ridges 156*a* for purposes hereinafter described.

The intermediate element 120 includes a tubular portion 160 of square cross section. A tooth or ridge 160*a* extends from the portion 160 for purposes hereinafter described.

The jamb 111 may be assembled as shown in FIG. 7 by inserting the elongated portion 124 of element 121 into the cavity 153 of intermediate element 120. The teeth or ridges 132*a* of portion 124 engage with the teeth 156*a* of intermediate element 120. The elongated element 124 is inserted to a depth sufficient to provide the desired depth of jamb 11 for the building in which the jamb 11 is being installed. The teeth 132*a* and 156*a* serve to lock the elements 120 and 121 in the desired depth. The jamb 111 is further assembled by inserting the element 122 into the cavity 152 until the projection 155*a* rests in the slot 122*a* in element 122. The projection serves to lock the element 122 in place with respect to the element 120. A seal 180 may be secured in place trapped against member 122 by tooth or ridge 160*a*.

USE OF THE PRESENT INVENTION

Figure 9:
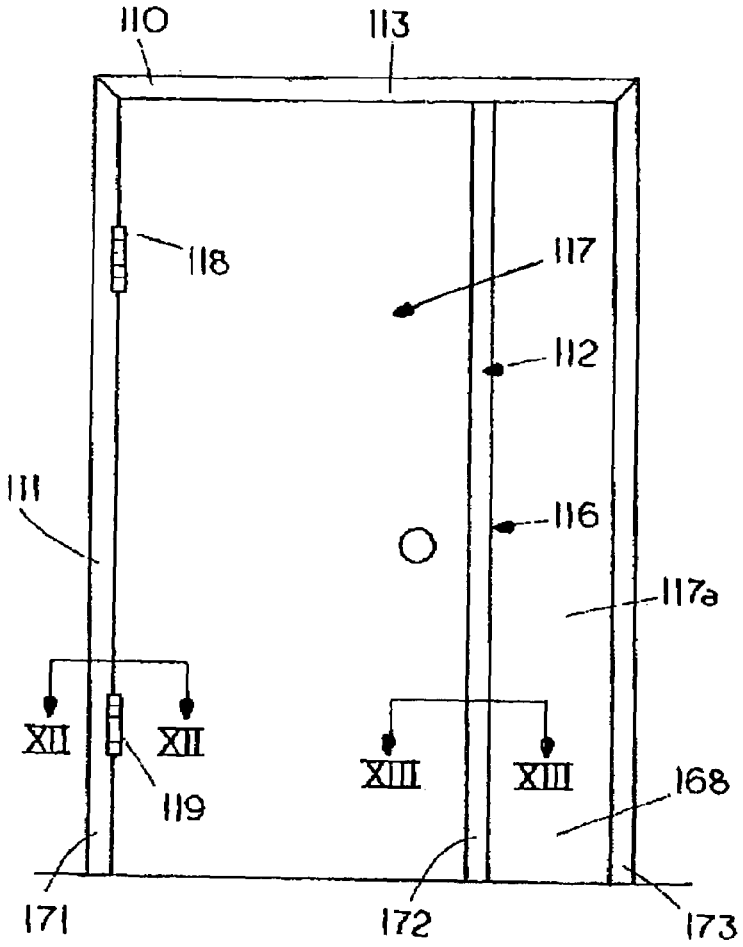
FIG. 9 shows a vertical plan view of the entry way of a residence showing the use of the jamb of FIGS. 7 and 8.
Figure 12:
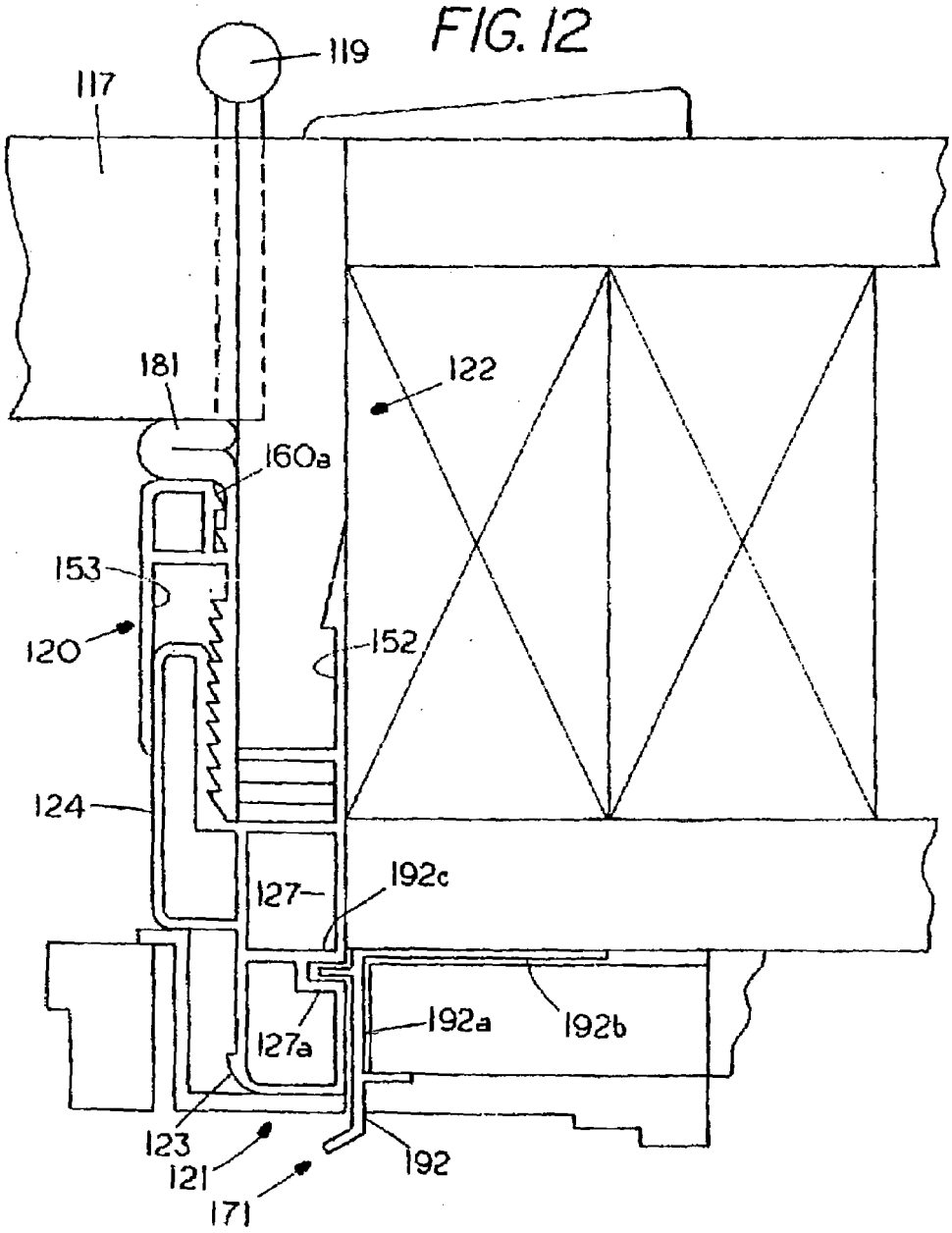
FIG. 12 shows a sectional view taken along the line XII—XII in FIG. 9.
Figure 13:
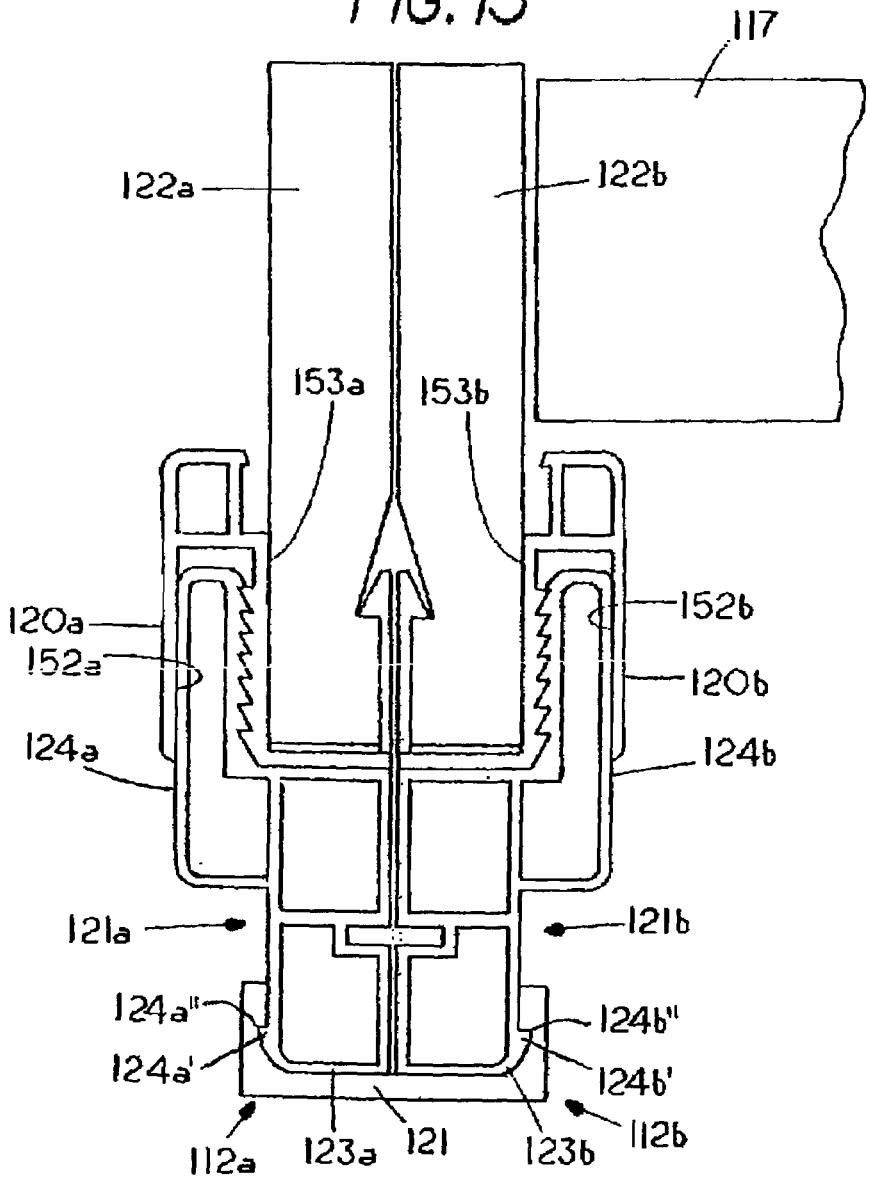
FIG. 13 shows sectional view taken along the line XIII—XIII in FIG. 9.

The present jamb may be used in any of various door configurations including a single door, patio glass doors, transoms, sidelights and door structures that include two or more doors. The jamb of the present invention is shown in FIG. 9 in a door configuration including a single door 117 and a light 168. In the configuration of FIG. 9 four jambs 171, 172 and 173 are provided. Jambs 171 and 173 are single jambs as shown in FIG. 12. The jamb 172 is a double jamb as illustrated in FIG. 13.

The jamb 171 includes three elements namely outer element 121, intermediate element 120 and inner element 122. The outer element 121 has an exposed low maintenance portion 123 and an elongated portion 124 as described in conjunction with FIGS. 7 and 8 The intermediate element 120 may include a pair of oppositely facing cavities 152 and 153 defined by a plurality of walls. The structural element 122 may be formed from a wood board such as pine, oak or fir. The elongated portion 124 of outer element 121 is engaged in the cavity 153 of intermediate element 120. The structural element 122 is engaged in the cavity 152. The jamb 171 has weather stripping 181 (FIG. 12) held in place by entrapment between intermediate element 120 and structural element 122. The tooth or ridge 160*a* holds the weather stripping or seal 181 in place. The weather stripping 181 serves as a seal between the jamb 171 and the window or door 117.

The jamb 172 (FIGS. 9 and 13) is as described with respect to the jamb 111 except two jambs are placed back to back to provide a first finished surface facing toward the door 117 and a second finished surface facing toward the side light 117*a*. Referring to FIG. 9 it is noted that a first jamb 112*a* faces to the left, e.g., toward the door and a second jamb 112*b* faces to the right, e.g., toward the side light 117*a*. The jamb 112*a* includes three elements namely outer element 121*a*, intermediate element 120*a* and inner element 122*a*. The outer element 121*a* has a low maintenance outer portion 123*a* and an elongated portion 124*a* as described in conjunction with FIGS. 7 and 8. The intermediate element 120*a* may include a pair of oppositely facing cavities 152*a* and 153*a* defined by a plurality of walls. The structural element 122*a* may be formed from a wood board such as pine, oak or fir. The elongated portion 124*a* of outer element 121*a* is engaged in the cavity 152*a* of intermediate element 120*a*. The structural element 122*a* is engaged in the cavity 153*a*. The jamb 112*b* likewise includes three elements namely outer element 121*b*, intermediate element 120*b* and inner element 122*b*. The outer element 121*b* has an exposed low maintenance portion 123*b* and an elongated portion 124*b* as described in conjunction with FIGS. 7 and 8. The intermediate element 120*b* may include a pair of oppositely facing cavities 152*b* and 153*b* defined by a plurality of walls. The structural element 122*b* may be formed from a wood board such as pine, oak or fir. The elongated portion 124*b* of outer element 121*b* is engaged in the cavity 152*b* of intermediate element 120*b*. The structural element 122*b* is engaged in the cavity 153*b*. A cap 191 is mounted over the outer portion 124*a* and 124*b* to seal the space therebetween and secure the jambs 112*a* and 112*b* together. The outer portions 124*a* and 124*b* may each include a projection 124*a*' and 124*b*' that engages a slot 124*a*" and 124*b*" in the cap 191 to secure the cap 191 in place.

Figure 14:
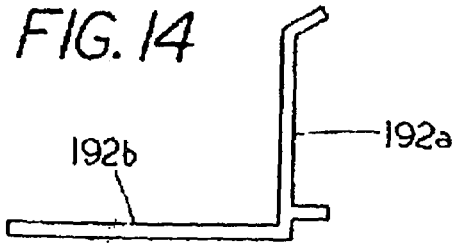
FIG. 14 shows a drip cap or flashing of the present invention.

The jamb 171 may include a flashing 192 that extends along the edge of the jamb 171 and is engaged with the framing of the rough opening in the home. The flashing 192 is illustrated in FIG. 14. The flashing is an elongated I-shaped member including a flange 192*a* and 192*b*. The flange 192*a* lies in snug engagement with the outer portion 124. The flange 192*b* lies in snug engagement with the exterior surface of the home, e.g., the exterior sheeting. The flashing 192 has a projection 192*c* that extends into the slot 127*a* in wall 127.

ALTERNATE EMBODIMENT

Figure 10:
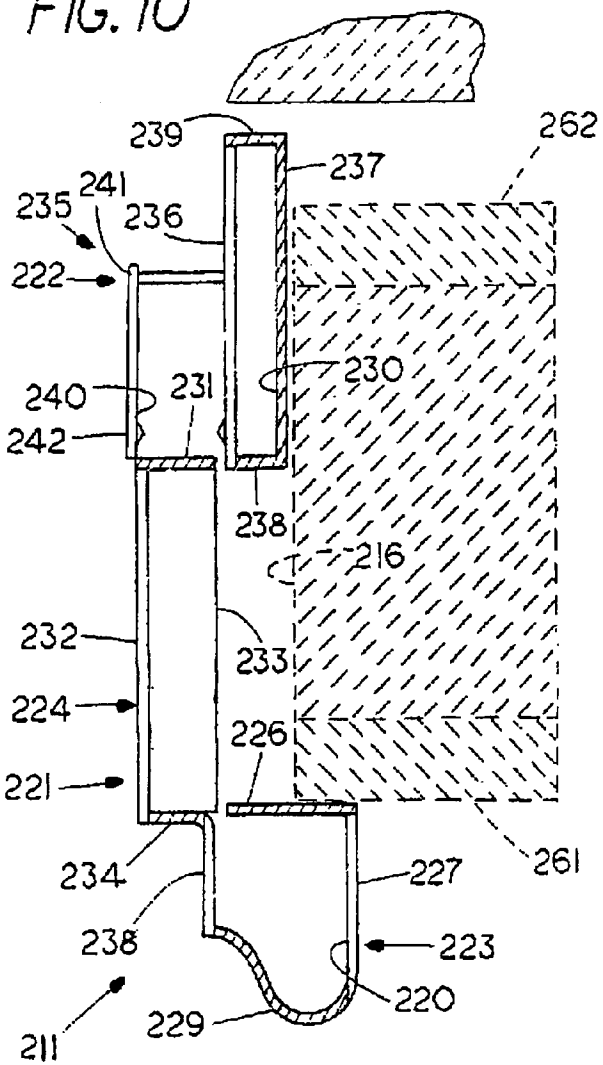
FIG. 10 shows an exploded sectional view of an alternate embodiment of the present invention.

The side jamb 211 (FIGS. 10 and 11) includes an exterior decorative element, e.g., first element 221 and an inner structural element 222. The first element 221 may be constructed by extrusion of a polymeric material, such as vinyl in a shape as shown in the cross sectional view of FIG. 10. The decorative element 221 has an exposed portion 223 and an elongated portion 224. The exposed portion 223 may include a rear wall 226, a pair of side walls 227, 228 and a outer shaped wall 229. The shaped wall 229 is shown as being S-shaped; however, the wall 229 may be of any desired conformation, such as angular or semi-circular. The elongated portion 224 may include an inner wall 231, a pair of side walls 232, 233 and an outer wall 234. The exterior element 221 may be extruded in the form of a closed, continuous shaped tube 220. The walls 226, 227, 228, 229, 231, 232, 233 and 234 may be integral with the next adjacent wall. In other words, wall 226 is integral along one edge with the adjacent edge of wall 227 which in turn is integral along one edge with the adjacent edge of wall 229 and so on.

The structural element 222 may be an extruded tube having a closed tube portion 230 defined by walls 236, 237, 238 and 239 and an open tube portion 235 defined by the walls 236, 241 and 242. The cavity 240 formed by the walls 236, 241 and 242 functions as a track into which the elongated portion 224 may be placed as hereinafter described. The cavity or track 240 desirably has dimensions that snugly receive the elongated portion 224 of first element 221.

The second element 222 (FIGS. 10 and 11) may be generally rectangular in cross sectional shape with an extended rectangular portion. The element 222 may have a depth suitable to conform the desired range of home wall thickness in combination with element 221.

Figure 11:
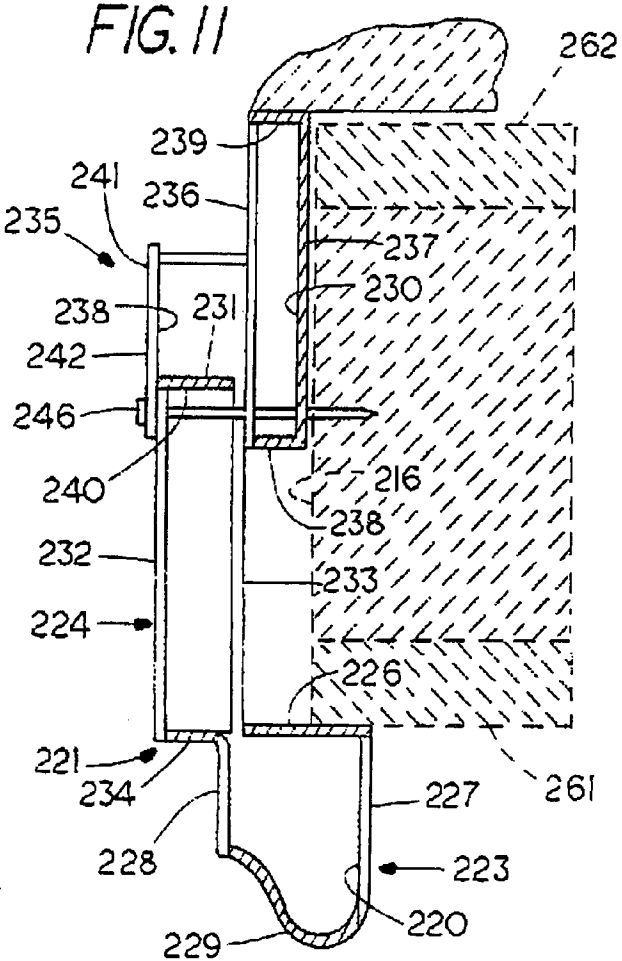
FIG. 11 shows a sectional view of the embodiment of FIG. 10 in an assembled position.

The engagement between elements 221 and 222 is illustrated in FIG. 11. The wall 226 abuts the outer surface 261 of the siding of the building in which the door jamb is being mounted. In other words, the elongated portion 224 of element 222 is partially disposed within the track 240 of element 222. Element 221 is adjusted in such track 238 to provide the desired depth dimension for the door jamb. The portion 224 enters the cavity 240 to a sufficient depth to place end wall 239 in alignment with the surface 262 of the inside wall materials, e.g., dry wall in the home as shown in FIG. 11.

The elements 221 and 222 may be suitably secured together such as by nails or screws 246 which engage the framing dimensional lumber, e.g., 2×4's to secure the relationship once the door jamb is on location and has been put in place in the rough opening. The element 222 is moved to provide the desired thickness for the jamb and nails or screws 246 are inserted through element 222 into element 221. The doorjamb 10 may be suitably secured to the dimension lumber, e.g., 2×4 such as by the nails or screws 246.

The invention claimed is:

1. A door jamb comprising a pair of upright side jambs and a horizontal head jamb, said upright side jambs each having an upper end, said horizontal head jamb having two outer ends, said horizontal head jamb disposed between and interconnecting said upper ends of said side jambs;

said upright side jambs and said head jamb each being constructed of an outer low maintenance element, an intermediate low maintenance element and an inner element;

said outer element comprising an elongated tubular structure including an outer portion and an elongated portion, said elongated portion including walls defining a cavity;

said intermediate element including walls defining a pair of oppositely facing cavities, one of said cavities being an outwardly facing cavity and the other of said cavities being an inwardly facing cavity;

said inner element being an elongated portion having an inner exposed surface adapted for alignment with the surface of the inner wall of the residence in which the door jamb is mounted, said elongated portion of said outer element being partially inserted into said outwardly facing cavity, said inner element being partially inserted into said inwardly facing cavity;

means for securing the outer element, said intermediate element and said inner element into a rough door opening.

2. The door jamb of claim 1 wherein said intermediate element is S-shaped in cross section and said cavities include means for securing said outer element to said intermediate element.

3. The doorjamb of claim 1 wherein said intermediate element is S-shaped in cross section and wherein at least one of said walls defining said intermediate element cavity includes means for securing said inner structural member to said intermediate element.

4. The door jamb of claim 2 wherein said outer element includes means for engaging said securing means of said intermediate element to lock said outer element and said intermediate element together.

5. The door jamb of claim 4 wherein said outer element comprises an extruded tubular element.

6. The door jamb of claim 5 wherein said intermediate element comprises an extruded element.

7. A doorjamb comprising a pair of upright side jambs and a horizontal head jamb, said upright side jambs each having an upper end, said horizontal head jamb having two outer ends, said horizontal head jamb disposed between and interconnecting said upper ends of said side jambs;

said upright side jambs and said head jamb each being constructed of a first element, a second element and an intermediate element;

said first element comprising an elongated tubular structure including a decorative portion and a structural portion, said intermediate element including walls defining a pair of oppositely facing cavities;

said second element being an elongated tubular structure having an exposed surface aligned with the surface of the inner wall of the residence in which the door jamb is mounted, said first element and said second element each having a portion partially inserted into a selected of said pair of cavities defined in the intermediate element;

means for securing the first, second and third elements into a rough door opening.

8. The doorjamb of claim 7 wherein said first element comprises an extruded tubular element.

9. The doorjamb of claim 8 wherein said second element comprises an extruded tubular element.

10. The door jamb of claim 9 wherein the upper end of each of said side jambs and outer ends of said head jamb are connected using a corner key.

11. A residential structure having an opening comprising a pair of upright side jambs and a horizontal head jamb, said upright side jambs each having an upper end, said horizontal head jamb disposed between and interconnecting said upper ends of said side jambs;

said upright side jambs and said head jamb each being constructed of a first tubular element, a second tubular element and an intermediate element;

said first element comprising an elongated structure having a thickened portion adapted to serve as a decorative strip disposed along said opening and an elongated portion of reduced thickness, said second element including wall means;

said intermediate element defining first means engaging with a portion of the first element, said intermediate element defining second means for engagement with said wall means of said second element to provide the selected width for the respective door jamb member.

12. A door jamb comprising a pair of upright side tubular jambs and a horizontal tubular head jamb, said upright side jambs each having an upper end, said horizontal head jamb having a pair of outer ends, said horizontal head jamb disposed between and interconnecting said upper ends of said side jambs;

said upright side jambs and said head jamb each being interconnected by a key extending into the tubular side jamb and into the tubular head jamb;

said upright side jambs and said head jamb each including a first element, a second element and a third element, said first element comprising a low maintenance element, said third element being S-shaped in cross section thereby providing a first cavity opening toward said first element and a second cavity opening toward said second element, said first cavity receiving a portion of said first element and said second cavity receiving a portion of said second element thereby interconnecting said first and second elements and providing means for adjusting the width of said jambs.

13. The doorjamb of claim 12 wherein each of said side jambs comprise a first element, a second element and a third element, said first element comprising an elongated tubular structure having a decorative portion, a structural portion and a portion for engagement with said third element;

said second element being an elongated tubular structure having an exposed surface adapted for alignment with the surface of the inner wall of the residence in which the door jamb is mounted, said second element having a portion adapted for engagement with said third element, said third element securing said first element and said second element together as a single unit.

14. The door jamb of claim 13 wherein one of said elements includes a plurality of walls defining an S-shaped cavity for reception of a portion of the other element for securing said elements together as a unit.

15. A door jamb comprising a pair of upright shaped side tubular jambs and a shaped horizontal tubular head jamb, said upright side jambs each having an upper end, said horizontal head jamb having a pair of outer ends, said horizontal head jamb disposed between and interconnecting said upper ends of said side jambs;

means securing said outer ends of said horizontal head jamb and the adjacent upper end of said upright side jambs into a single unit;

said horizontal head jamb and said side jambs each including an outer element, inner element and an S-shaped intermediate element, said intermediate element serving to interconnect said outer element and said inner element.

16. A door jamb having a pair of extruded tubular side jambs and an extruded tubular head jamb, said side jambs and said head jamb each comprising a first element, a second element and a third element, said third element having walls defining an S-shaped track, said track including a first cavity facing said first element and a second cavity facing said second element, said first and second elements each including a portion at least partially disposed within said track, said second element being selectively positioned within said track to provide a desired depth of the door jamb.

* * * * *